United States Patent [19]

Atherton et al.

[11] Patent Number: 4,532,997

[45] Date of Patent: Aug. 6, 1985

[54] PROTECTIVE SYSTEMS

[75] Inventors: John R. Atherton, Corsham; John H. Sindall, Stourport-on-Severn; Osmond R. Heathcock, Stourbridge, all of United Kingdom

[73] Assignees: The Secretary of State for Defence in Her Britannic Majesty's Government of the United Kingdom of Great Britain and Northern Ireland, London; IMI Kynoch Limited, Birmingham, both of England

[21] Appl. No.: 84,468

[22] Filed: Oct. 4, 1979

[30] Foreign Application Priority Data

Oct. 4, 1978 [GB] United Kingdom ..... 39317/78

[51] Int. Cl.[3] ..... F42B 37/02; A62C 37/04

[52] U.S. Cl. ..... 169/56; 169/62; 206/3

[58] Field of Search ..... 109/20, 29, 32, 33, 109/34, 42; 169/43, 46, 47, 56, 58, 60, 61, 62; 206/3; 220/88 R; 340/289, 550, 578; 89/1.812

[56] References Cited

U.S. PATENT DOCUMENTS

| | | | |
|---|---|---|---|
| 154,896 | 9/1874 | Parker | 109/33 |
| 2,693,240 | 11/1954 | Glendinning et al. | 169/61 |
| 2,798,562 | 7/1957 | Randolph et al. | 169/61 |
| 3,090,197 | 5/1963 | Lapp et al. | 340/578 |
| 3,703,930 | 11/1972 | Lofstrand et al. | 169/60 |
| 3,738,428 | 6/1973 | Ingro | 169/62 |
| 3,952,808 | 4/1976 | Richardson | 169/61 |

*Primary Examiner*—Stephen C. Bentley

*Attorney, Agent, or Firm*—Cushman, Darby & Cushman

[57] ABSTRACT

Storage apparatus for combustible or explosive material, the apparatus comprising a substantially closed, heat-resistant container, an opening in a wall of the container to enable flow of quenching fluid into the container from an external supply of said quenching fluid, a valve which normally prevents flow of said quenching fluid into the container through the opening and detector means responsive to penetration of a wall of the container by a projectile or fragment and which, in the event of such penetration occurring, opens the valve to enable said quenching fluid to flow into the container through the opening, thereby controlling or preventing fire or explosion.

14 Claims, 4 Drawing Figures

PROTECTIVE SYSTEMS

This invention relates to the storage of combustible or explosive materials or articles comprising such materials, particularly but not exclusively ammunition such as missiles, torpedos, depth charges and gun shells.

Gun propellants, missile propellants and warheads, for example, usually comprise solid combustible materials which are not particularly ignitable when handled normally but which may be initiated by a substantial and/or sustained rise in temperature. Storage of ammunition on fighting vehicles, for example tanks and ships, is a long standing problem. The storage apparatus is clearly liable to "attack" whether directly by an aimed projectile or incidentally due to a splinter or fragment from a nearby explosion. Propellants or explosives may ignite if struck by such projectiles and fragments and any resulting explosion or fire may ignite any nearby propellant or explosive.

In the case of tanks, it is conventional practice to protect stored ammunition by means of armour-walled containers. However, such containers bring their own problems. Firstly, increased armour increases the weight of the vehicle, reducing its manoeuvrability. Some armour, particularly metal armour, will tend to heat fragments which do penetrate it, thereby increasing the risk of explosion or ignition of material stored within the container. Further, the armoured container provides a confining means for the material within it, substantially increasing the violence of the combustion of the material within if the latter is ignited. This can lead to violent explosions, the effects of which are far worse than the effects of the initial attack. In the case of naval ships, it is not practicable to store missiles, for example, in heavily armoured containers which would, in any event, have the disadvantage described above and it is conventional practice to store such missiles in open magazines which give little protection against projectiles, fragments and fire.

It has been proposed (see for example UK Patent Specification Nos. 1 121 521 and 1 213 138) to store propellant in individual containers in a box which is filled with a quenching liquid, usually water with or without suitable additives. The container for an individual propellant charge normally isolates the charge from the surrounding water. However, if the box and the container are penetrated by a fragment, the water in the box can follow the fragment through the hole in the wall of the container to prevent ignition of the container contents.

Storage systems of the type shown in the prior British patents, and of the type envisaged by this invention, are intended to deal in particular with fragments or projectiles which are small relative to the storage apparatus, so that the various box and container walls are penetrated only locally. This leads to a difficulty in hitherto proposed systems in that the individual charge containers are designed to retain a substantial degree of integrity after local penetration, so that the quenching liquid must follow a fragment into the charge container through quite a small hole. The resulting dousing of the propellant or other material in the container may be too late or insufficient to prevent ignition.

The present invention provides storage apparatus for combustible or explosive material, particularly but not exclusively articles comprising such a material, for example a missile or torpedo, the apparatus comprising a substantially closed, heat-resistant container, an opening in a wall of the container to enable flow of fluid, for example water, into the container from an external supply of said fluid, a valve which normally prevents flow of said fluid into the container through the opening and detector means responsive to penetration of a wall of the container by a projectile or fragment and which, in the event of such penetration occurring, opens the valve to enable said fluid to flow into the container through the opening.

By using apparatus of the invention, excessive burning or explosion of material stored in the container may be prevented in the event of a high velocity projectile or fragment piercing the container and striking the material. In that event, the valve will be opened and dousing fluid, for example water, will at least partially fill the container and control any fire.

In a preferred embodiment, the container is such that its material of construction will not be significantly damaged, in particular not melted or decomposed, by external fire, for example petroleum-fuelled fire, within a period sufficient effectively to deploy fire-fighting equipment. We have found that a container made of sheet steel is generally acceptable, but other materials such as heat-resistant, mechanically strong plastics materials are equally acceptable. Preferably, the container is made of a laminated material comprising a layer of a heat-resistant rubber such as neoprene sandwiched between two steel sheets. The container may be fabricated by any suitable method, for example it may comprise a plurality of sections welded together and, in the case of especially large containers for storing large missiles, the sides of the container may be strengthened by bracing.

The container preferably comprises means which, in the event of a sudden build-up of gas pressure in the container as a result of ignition of, for example, propellant therein, can vent gas when the pressure exceeds a predetermined minimum value so preventing destruction of the container by bursting. The venting means may comprise a purpose-built pressure-relief valve or, for example, a wall of the container may be arranged temporarily to open, for example against spring pressure, to vent pressurized gas until pressure in the container drops to said predetermined value. In addition, the container should, of course, be relatively easily openable so that there is ready access to, for example, a missile within the container for the purpose of removing or servicing it.

Further, the container is preferably compartmentalized so that fluid can be selectively fed into, and confined to, one or more of the compartments. As an example, a container for a typical missile is preferably divided laterally into three end to end compartments as, and for the reasons, described hereinafter with reference to the accompanying drawings. In the case of some torpedos, however, it will usually suffice to divide the container laterally into two compartments, fluid being directed only into that compartment housing the warhead, the rest of the torpedo being non-hazardous. By compartmentalizing the container, the dead space (i.e. the space between the walls of the container and the external surface of the missile or other object in the container) that needs to be filled or partially filled with fluid such as water may be minimized whereby, other factors being equal, the quenching efficiency may be maximized. In addition, it may not be necessary to provide detector means to detect penetration of the walls of a compartment having non-hazardous parts of, for example, the missile or torpedo because penetration of a projectile into such a compartment is unlikely to create a danger.

The opening in a wall of the container should be sufficiently large that the quenching fluid, usually water under pressure, can pass into the container at an acceptably high rate. As an example, in the case of a container having a volume of 2 $m^3$ and sized to accept a specific missile leaving an optimum amount of dead space, the opening preferably should have a cross-sectional area of the order of 45 $cm^2$ when quenching water at 10 atmospheres pressure is used. This should enable sufficient water to enter the container very quickly, thereby at least partially filling the dead space therein within a few seconds, for example about two seconds, of penetration of the container by a fragment or a projectile which in most cases will be sufficiently quick that deflagration or explosion of a material within the container will be prevented. As will be appreciated, in any given instance the appropriate water feed rate may be attained by varying the water pressure and/or the cross-sectional area of the opening. The water or other quenching fluid may be fed as a single stream directly through the opening or the opening may communicate with a manifold positioned internally of the container. Thus, the manifold may serve simultaneously to feed quenching fluid, for example in the form of a plurality of sprays, to different parts of the container which has obvious advantages, particularly in cases where a projectile penetrates the container in a region thereof remote from the opening. As an alternative, the container may be provided with a plurality of spaced openings through each of which water can be fed into the container upon opening of the valve.

The valve may be of any suitable type, but it should be quick-acting and allow a sufficiently high fluid throughput. A number of suitable valves is commercially available and two examples are shown in the accompanying drawings. One of the exemplified valves is electro-mechanically operated and the other is of the frangible disc type. Valves of the latter type are available from Imperial Chemical Industries Limited under the Registered Trade Mark "Metron". Preferably there is also provided means to shut off the flow of quenching fluid when a sufficient quantity thereof has entered the container. This prevents the walls of the container, if totally filled with water, being subjected to the force of pressurized fluid which might otherwise damage the container.

The detector means may be any one of a number of types. Examples of suitable types are the so-called "shorting screen" type, the integrated pulse type, light detectors and mechanical shock detectors. The shorting screen type of detector may comprise a thin layer of electrically insulative material, for example brown paper, sandwiched between two thin layers of electrically conductive material, for example a metal foil such as aluminium foil, substantially the whole of the internal surface of the container being lined with such a laminate. In the event that the container is pierced by a high velocity projectile or fragment, the laminate also will be pierced by the projectile or fragment resulting in the two foils electrically shorting. By incorporating the laminate in an appropriate electrical circuit, the electrical short may be utilized to open the valve which in turn allows rapid inlet of quenching liquid into the container. The integrated pulse type of detector relies on detecting specific pulse forms obtained when the container and then a missile within the container are struck by a high velocity projectile or fragment. Light detectors, of which there preferably is a plurality inside the container when this sort of detector is used, rely on the fact that when a high velocity projectile or fragment penetrates a material, particularly a metal, a flash of light is generated. The light, which may, for example, be visible light or preferably infra-red light, is sensed by the detector(s) and, for example, converts the radiant energy into an electrical potential (by the photoelectric effect) which may be utilized to open the valve. Light generated in one part of the container may be sensed by a remote detector by means of an optical fibre link. Finally, mechanical shock detectors merely sense shock and, when the shock (generated, for example, by a projectile striking the missile after it has penetrated the container) is above a predetermined amount, generate a signal which may be utilized to open the valve.

The present invention also provides a container for incorporation in an apparatus of the invention, the container comprising a substantially closed, heat-resistant vessel for containing combustible or explosive material, at least one opening in the vessel for admitting fluid, for example, water, thereinto and, located inside the container, means to sense penetration of a wall of the vessel by a projectile or fragment.

Although the invention is intended primarily for specialized applications, conventional goods containers, for example, may be readily adapted to accommodate features of the invention whereby dangerous materials of virtually any type may be relatively safely transported in "container" lorries or ships. For example, a plurality of containers of the invention, each containing dangerous materials or articles, may be transported and stored in a single conventional goods container, the latter being connected to, or incorporating, a supply of quenching fluid and each container being connected to the supply via a valve. In such cases, there will preferably be a main pipeline connected to the supply, the containers being connected "in parallel" to that pipeline; there may be just one valve, in the pipeline, so that if any one or more of the containers is penetrated then all of the containers are flooded or each container may have its own valve so that flooding will be confined to the or each container actually penetrated. Alternatively, a conventional goods container itself may be adapted to a container of the invention.

The invention will now be described in more detail, by way of example only, with reference to the accompanying drawings, of which:

Figure 1:
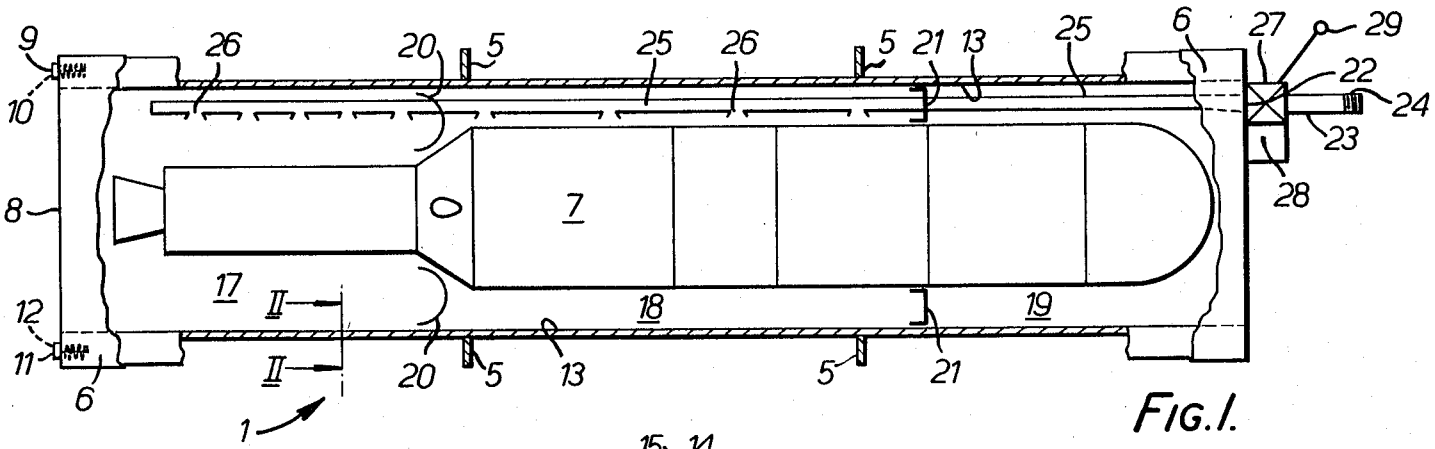
FIG. 1 is a diagrammatic, out-away plan view of an apparatus of the invention showing a missile stored in the container.
Figure 2:
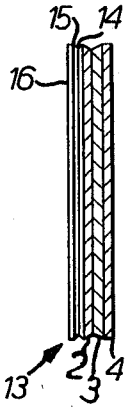
FIG. 2 is a view, on an enlarged scale, through the line II—II of FIG. 1.

Referring to FIGS. 1 and 2 of the drawings, an oblong container designated generally by reference numeral 1 is made of a rubber-steel sheet laminate. Referring particularly to FIG. 2, the laminate comprises, for example, an inner sheet 2 of 0.6 mm thick steel, a middle layer 3 of 2.5 mm thick callendered neoprene and an outer sheet 4 of 0.6 mm thick steel. The steel sheets 2 and 4 are preferably painted or otherwise coated to inhibit corrosion thereof. Alternatively, at least the outer sheet may be of, for example, stainless steel. The vertical side walls of the container 1 are strengthened at intervals along their respective lengths with bracing 5. The container 1 has a detachable lid 6 and houses a missile 7 mounted on shock-absorbing rails (not shown). One of the end walls 8 of the container 1 is attached to the vertical side walls of the container 1 by compression spring-loaded bolts 9, 10, 11 and 12, the springs being compressed by a predetermined amount. Excess gas pressure that might build up in container 1 as a result of accidental ignition of the missile propellent can, therefore, be relieved through the end wall 8.

The internal surfaces of container 1 are lined with a "shorting screen" detector designated generally by reference numeral 13 which comprises a laminate of aluminium foil 14, electrically insulative brown paper 15 and a further aluminium foil 16. The functioning of such a detector has been briefly described earlier in this specification and, as already mentioned, other types of detector may be used.

As can be seen from FIG. 1, the particular container shown is compartmentalized into three sections 17, 18 and 19 by means of bulkheads 20 and 21. Section 17 houses the boost portion of the motor of missile 7. This particular portion of the motor constitutes a major hazard because, if struck by a high velocity projectile or fragment, it is liable to explode. Section 18 houses the sustainer portion of the missile motor and the warhead which constitute less of a hazard than does the boost portion as they will usually only burn if struck by a projectile or fragment. Section 19 houses the guidance and control system of the missile 7 and is not hazardous. Accordingly, it is usually necessary to feed quenching fluid, for example water, only into sections 17 and 18 of the container 1 in the event of a projectile or fragment piercing the container 1. More especially, it is advantageous, in such an event, rapidly to flood section 17 whereas it will usually be necessary only to spray water onto the outside of the sustainer portion housed in section 18. Compartmentalization of the container 1 maximizes quenching efficiency by reducing to a minimum the volume of container 1 that needs to be filled or partially filled with water in the event of an accident. Further, if desired, it may not be necessary to line the walls of section 19 with detector laminate because penetration of a wall of that section is unlikely to create a hazard.

The other end wall of the container 1 is provided with an opening 22 through which a pipe 23 passes. The pipe 23 terminates outside the container 1 in a coupling 24 for permanent attachment, during service of the apparatus, to a hose-pipe. As an alternative, for example, the pipe 23 could be directly connected to an adjacent or nearby reservoir containing quenching fluid, for example water. Internally of the container 1 the pipe 23 is connected to a manifold 25 having a plurality of spray nozzels, some of which are indicated by numeral 26. So that the high risk section 17 can be quickly flooded with water the manifold 25 is designed to deliver a major portion of the total water to that section.

Figure 3:
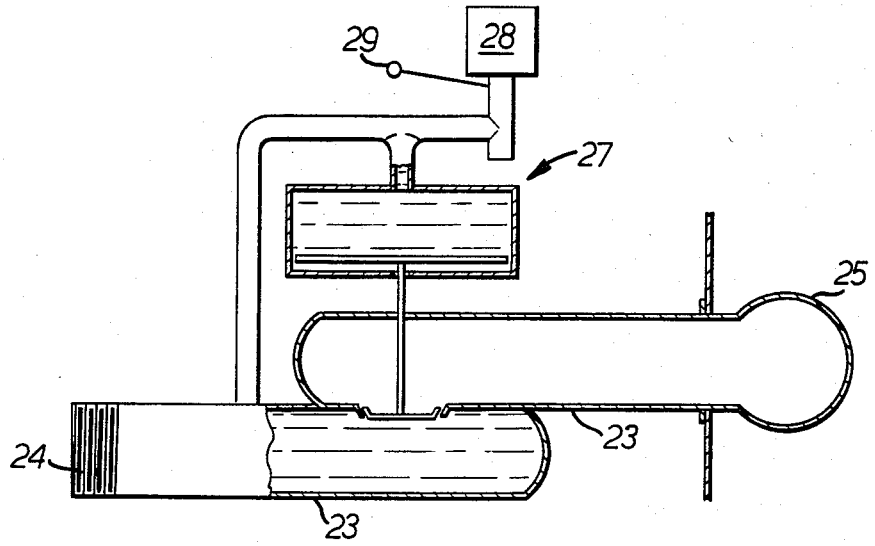
FIG. 3 is a diagrammatic representation of a suitable quenching fluid valve.

The pipe 23 includes a fluid flow valve 27, an example of which is shown in FIG. 3. The valve is mounted on the external surface of the container, as shown, and is normally closed but is rapidly openable, as described below, in response to a high velocity fragment or projectile piercing the container 1 and hence the laminate detector 13.

Figure 4:
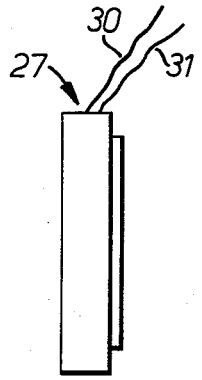
FIG. 4 is a diagrammatic representation of an alternative valve.

FIG. 4 illustrates a preferred form of valve 27. It is in the form of a disc-like closure device which may be axially located in the pipe 23 or in the inlet end of manifold 25. The device includes an explosive charge that is electrically initiable via leads 30, 31. Upon initiation, the central portion of the disc is shattered thereby "opening" the valve. Such closures are manufactured by Imperial Chemical Industries under the Registered Trade Mark "Metron". Of course, such devices, once initiated, are not reusable but they can be readily replaced with a new device.

The detector 13 is associated with electrical equipment (indicated by numeral 28 and which includes an electrical power supply) which generates a signal to open the valve 27 when the aluminium foils 14 and 16 are shorted by a projectile or fragment that has pierced the container 1. In the case of the explosive devices just described the current generated by, for example, a photoelectric detector may be sufficient to actuate the devices so that a separate electrical power supply may not be required. Upon opening of the valve, water flows rapidly into selected parts (as indicated above) of the container 1 via manifold 25 and nozzles 26. The water may substantially prevent the occurrence of any fire as a result of the projectile or fragment striking the missile propellant or warhead or may prevent the spread of a fire already started and eventually extinguish it. In addition, the container 1 itself may largely contain any explosion initiated by the projectile of fragment. Preferably, the water is fed into the container 1, if necessary by a pump, at an elevated pressure, for example of the order of 10 atmospheres.

The valve 27 is preferably actuable also manually by means of a lever 29 and/or by remote control, for example from the bridge of a ship. Further, the apparatus preferably includes a thermal sensor which can cause the valve 27 to be opened when the sensor senses a temperature above a predetermined minimum value. Thus, in the event of a fire originating outside the container 1, the container may be flooded with water to provide added fire protection to the missile 7. Furthermore, the apparatus preferably also includes a shock sensor which can cause the valve 27 to be opened when said sensor senses a shock above a predetermined magnitude. As an example, the shock sensor may be sensitive to shock created by a depth charge.

In FIG. 1 of the drawings, the valve 27 and its associated electrical equipment 28 are shown to be mounted externally on the container. In alternative, but less preferred, embodiments of the invention the valve 27 and/or equipment 28 may be housed in the container 1 or may be located remotely therefrom.

As will be appreciated from the above, the present invention provides a relatively simple and inexpensive means of reducing the hazards of transporting and storing explosive or combustible materials whether one or by land, sea or air, provided that a source of quenching fluid such as water is available.

Usually, a container of an apparatus of the invention will contain, for example, a single missile or a set of smaller items, such as depth charges and a plurality of such missiles or sets would be kept on, for example, a warship in a corresponding number of containers which may be stored one upon another and/or side by side. In the event that one of the containers is struck, and penetrated, by a projectile or fragment, flooding of that container aids in confining any fire to that container thereby improving the chances of survival of ammunition stored in adjacent containers.

We claim:

1. Portable apparatus for storing a missile or torpedo, said apparatus comprising a rigid, protective container including supporting means for supporting therein, in a stable manner, a missile or torpedo, openable closure means through which said missile or torpedo can be loaded into, and removed from, the container, an inlet in a wall of the container for the passage of an aqueous quenching fluid into the container from an external pressurised source of said quenching fluid, a valve which normally prevents flow of said quenching fluid into the container through said inlet, and adjacent to the interior of a wall of said container detector means that will be penetrated by a projectile or fragment that penetrates a wall of the container, said detector means, in the event of, and immediately upon, such penetration of said detector means occurring, causing the valve to open thereby enabling said quenching fluid to flow into the container through said inlet.

2. Apparatus as claimed in claim 1 wherein the container is in the form of a substantially rectangular box and said closure means is a detachable or openable lid.

3. Apparatus as claimed in claim 1 wherein the container includes partitioning means so arranged that, when the missile or torpedo is located in the container, there are defined at least two substantially mutually isolated compartments within the container.

4. Apparatus as claimed in claim 3 including a manifold connected to said inlet and adapted selectively to distribute said fluid to at least a selected one, but not all, of said compartments.

5. Apparatus as claimed in claim 3 or in claim 4 wherein the manifold is adapted to distribute fluid to different compartments at different flow rates.

6. Apparatus as claimed in claim 1 wherein the container includes means to relieve excessive gas or other fluid pressure that may build up, in use, in the container.

7. Apparatus as claimed in claim 1 wherein the valve comprises an explosively frangible disc.

8. Apparatus as claimed in claim 1 comprising a plurality of said containers.

9. Apparatus as claimed in claim 8 wherein each container is connectable in parallel to a common supply of said quenching fluid.

10. Apparatus as claimed in claim 8 or claim 9 wherein the containers are associated with a corresponding number of said valves, one for each container, whereby only a container a wall of which is actually penetrated will receive said fluid.

11. Apparatus as claimed in claim 1 wherein the valve is openable by means independent of the detector means.

12. Apparatus as claimed in claim 11 wherein the valve is openable by manually operable remote control means.

13. Apparatus as claimed in claim 11 or claim 12 wherein the valve is openable in response to the detection, by at least one temperature sensor, of a temperature above a predetermined minimum valve within the or each container.

14. A storage container for storing a missile or torpedo in the form of a horizontal generally rectangular box having internal supporting means for stably supporting a missile or torpedo in a horizontal position, said box having an openable top closure through which a missile or torpedo can be loaded into and removed from the box, pressure-relief means responsive to a predetermined fluid pressure within the box for relieving fluid pressure from the box, an inlet in a wall of the box for the passage of a quenching fluid into the box from an external pressurized source of the quenching fluid, a valve external to the box normally preventing flow of quenching fluid into the box from the source through the inlet, detector means adjacent the interior surface of a wall of the box, the detector means being responsive to penetration thereof by a projectile or fragment that has penetrated the box to generate a signal, and means responsive to the signal to open the valve whereby quenching fluid flows into the box through the inlet.

* * * * *